United States Patent [19]

Goossens et al.

[11] 4,439,274

[45] Mar. 27, 1984

[54] METHOD AND CHIMNEY FOR REDUCING THE EMISSION OF SOLID PARTICLES

[75] Inventors: Walter Goossens, Wuerselen-Bardenberg; Wolfgang Schrank, Alsdorf, both of Fed. Rep. of Germany

[73] Assignee: Hartung, Kuhn & Co. Maschinenfabrik GmbH, Duesseldorf, Fed. Rep. of Germany

[21] Appl. No.: 308,784

[22] Filed: Oct. 5, 1981

[30] Foreign Application Priority Data

Oct. 11, 1980 [DE] Fed. Rep. of Germany ..... 3038519

[51] Int. Cl.[3] ..... C10B 31/00

[52] U.S. Cl. ..... 201/41; 55/84; 261/DIG. 54; 261/118; 202/263

[58] Field of Search ..... 55/90, 84, 240, 260, 55/444, 385 R; 261/DIG. 54, 118; 201/29, 39, 41; 202/263, 227; 110/119

[56] References Cited

U.S. PATENT DOCUMENTS

| | | | |
|---|---|---|---|
| 514,438 | 2/1894 | Blessing | 55/444 |
| 2,284,317 | 5/1942 | Greenberg | 55/90 |
| 2,858,903 | 11/1958 | Goetz | 261/DIG. 9 |
| 3,390,869 | 7/1968 | Alliger | 261/118 |
| 3,966,563 | 6/1976 | Armour et al. | 201/39 |
| 4,183,902 | 1/1980 | Hashimoto et al. | 55/90 |
| 4,282,068 | 8/1981 | Flockenhaus et al. | 202/227 |
| 4,322,269 | 1/1980 | Wagener et al. | 201/39 |

FOREIGN PATENT DOCUMENTS

| | | | |
|---|---|---|---|
| 2013102 | 3/1970 | France | 55/240 |
| 837398 | 6/1960 | United Kingdom | 202/227 |
| 844596 | 8/1960 | United Kingdom | 202/227 |

*Primary Examiner*—Bernard Nozick

*Attorney, Agent, or Firm*—W. G. Fasse; D. H. Kane, Jr.

[57] ABSTRACT

The emission of solid particles during the discharging of a horizontal coking oven or furnace is substantially reduced or eliminated. For this purpose the hot air and gas convection flow which carries the solid particles substantially vertically upwardly is exposed to a shower or spray of water drops which are directed substantially horizontally into the upward convection flow. The volume, surface tension, density and speed of the water drops are coordinated relative to one another so that the water drops are loaded by taking up the solid particles whereupon the loaded drops sink down in a countercurrent flow to the upward convection flow. The solid particles carrying the water drops are removed from the convection flow by a plurality of baffles arranged in a chimney or stack in a staggered relationship so that the upward convection flow can pass through between adjacent baffles which are inclined toward respective collecting channels.

8 Claims, 4 Drawing Figures

II
III
3''
11
1
2

14
3'
14
6
III
3
5
4
II

METHOD AND CHIMNEY FOR REDUCING THE EMISSION OF SOLID PARTICLES

CROSS REFERENCE TO RELATED APPLICATION

The present invention is based on German Patent Application No. P 3,038,519.4, filed in the Federal Republic of Germany on Oct. 11, 1980. The priority of said German Patent Application is hereby claimed.

BACKGROUND OF THE INVENTION

The invention relates to a method and chimney type apparatus for reducing the emission of solid particles which are generated, for example, when the charge of a horizontal chamber type coking furnace is discharged from the coking furnace for the subsequent quenching operation. In such a discharge operation the coking cake collapses as it is pushed into the quenching wagon, whereby the mixture of hot air, gas and solid dust particles forming above the collapsing coke cake is pulled as a heat convection current substantially vertically upwardly. For environmental reasons this particle laden heat convection current must be isolated from the atmosphere at least until the solid dust particles have been substantially cleaned out of the heat convection current or flow. Such cleaning may be accomplished in that the thermal lift or heat convection current is utilized in channelizing the mixture into a substantially vertically upwardly directed flow which is exposed to a liquid showering capable of binding or taking up the solid particle components of the flow. The invention is also directed to a chimney type apparatus for performing such a cleaning method.

It is known to use a so-called pressing machine for discharging a charge of coke from a horizontal chamber coking oven or furnace. The pressing machine presses the coke cake into a coke guide carriage which guides the coke cake into a quenching wagon or quencher car which transports the hot coke material to a quenching tower where the quenching is performed by means of water added to the hot coke material. During the pressing out operation when the quencher car is being loaded a strong thermal upwind is generated due to the high temperature difference between the coke cake as it is being pressed out of the coking chamber and the surrounding air. This strong thermal upwind vigorously entrains the dust particles which are liberated by the collapse of the coke cake, and the gases which are generated by an immediately occurring partial combustion. This upwind of a mixture of hot air and gases, as well as dust is clearly visible as a substantial dust output of prior art quenching systems. When, after completion of the pressing out operation, the coke has settled in the quenching car, and the loose, floatable dust particles have been carried off or whirled off so to speak in said upwind, no further coke dust emissions may be observed, except for the emissions resulting from the burn-off waste.

It is known to shower the collapsing coke cake with water by means of a showering device installed directly on the coke guide carriage in order to suppress the emission of coke dust. However, the coke guide carriage is not equipped with any devices for removing the solid particles bound to water droplets. Therefore, the emissions are precipitated in a zone more or less removed from the source of emission. However, it is an advantage of the just described direct showering of the coke with the water that the visual impression of the discharging materials is somewhat improved because the steam that is formed by the evaporating water envelopes the gray, solid particle laden cloud, thereby covering it with its lighter color. An actual reduction of the emission of solid particles cannot be achieved by this prior art method. However, the range of dust precipitation around the source of emission may be reduced in this manner.

However, the advantage of reducing the precipitation range which is achieved by the above described prior art method, must be compared with the substantial disadvantages which become primarily apparent in the form of substantial corrosion phenomena because the generated steam or vapor is capable of reducing the sulfur present in the high temperature coke. The predominant mass or proportion of such sulfur is organically bound in the carbon compound. However, the reduced sulfur makes the condensate formed from the vapor "acidic". Thus, the acidic condensate causes the corrosion of all metallic structural components of the coking furnace and of the plant.

Further, in the direct showering method the solid particles are rinsed into the rail track of the quenching car, whereby the drainage system is clogged and seepage of surface water into the ground is prevented. Thus, for example during a rainfall, the rail track system becomes flooded. It has been observed that such flooding water may even cause damage to the concrete structural components of the coking furnace plant.

German Patent Publication (DE-OS) No. 2,900,079 corresponding to U.S. Pat. No. 282,068, issued Aug. 4, 1981 discloses a method and apparatus for discharging the coke from a coking oven chamber with but little emission of solid particles in order to avoid the above described disadvantages. The disclosure of said German Patent Publication further intends to avoid in addition to the dust emission also an undesirable steam generation. According to this prior art a movable hood is arranged above the quenching car. The coke is sprayed with water from nozzles under the hood and the steam generated in the hood including any possibly present infiltrated air are sucked out of the hood or the steam is condensated in the hood. The water spraying of the hot coke is supposed to take place primarily in the lower zone of the hood so that necessarily substantial quantities of steam are generated in addition to the air infiltration. Such generated steam quantities and infiltrated air quantities must be sucked off and condensed.

Thus, such a device for performing this showering or spraying method is at least as expensive as extensive hood or hall systems in which the dust and gas laden air is entrapped, sucked off, and cleaned.

German Patent (DE-PS) No. 1,771,506 discloses a device constructed for entrapping the dust quantity produced during the pressing out of a coke charge from a horizontal chamber oven by means of a trapping hood. The so entrapped air carrying the dust is washed and then discharged into the atmosphere. For this purpose German Pat. No. 1,771,506 discloses a coke cake guide carriage which is equipped with said entrapping hood for the emitted dust and with suction devices as well as with washing equipment for the dust laden air. In this prior art system a discharge flue is arranged above the entrapping hood. The flue has a vertical central axis which is displaced relative to the entrapping hood. The flue is further equipped with sets of baffle means and with showering or spraying devices. A transition member is arranged between the entrapping hood and the discharge flue. The transition member has a cross-section which corresponds to the cross-section of the discharge flue and which is approximately half as large as the lower hood opening.

The just described prior art system disclosed in German Pat. No. 1,771,506 has the significant disadvantage that it is not possible to sufficiently prevent a contact between the washing liquid and the coke as it is being pressed out. This contact between the coked material as it is being pressed out and the washing liquid causes a sulfur emission. This is so because in high temperature coke the sulfur component is primarily present in an organic compound. Thus, if the coke comes into contact with water a water gas reaction is unavoidable, whereby the generated hydrogen is in a molecular state, that is in the nascent state which is capable of reducing the sulfur out of its carbon compound.

Another disadvantage of the just described system according to German Pat. No. 1,771,506 is seen in that the discharge flue is arranged with its central longitudinal axis in a displaced position relative to the catching hood. This position enforces a detour of the air gas dust mixture which prevents an optimal utilization of the thermal convection current generated by the pressing operation. Further, the direct spraying of the air gas dust mixture in countercurrent flow from the top downwardly impedes the thermal upwind or heat convection upward flow.

Summarizing the prior art, it may be said that all known systems for reducing the emission during the pressing out operation of a coke charge out of a horizontal chamber furnace are not only very expensive and involved, thereby increasing the production costs of the coke substantially, they also are unsatisfactory in their function. Besides, such prior art systems required for performing these known methods may be employed and operated only with a very high additional expense due to the frequent lack of space and due to furnace foundation structures which are all too often inadequate for the additional equipment.

OBJECTS OF THE INVENTION

In view of the above it is the aim of the invention to achieve the following objects singly or in combination:

to provide a method for the reduction of solid particle emissions, particularly of sulfur emissions during the pressing out operation of a coke charge from a horizontal chamber furnace;

to substantially reduce or even eliminate the emission of solid particles from a coke pressing operation without the use of expensive hood or hall systems and without special ventilator or suction devices for conveying the air gas dust mixture or components of such a mixture;

to avoid the use of cleaning devices which heretofore have required an electrical drive system;

to substantially reduce the operation and maintenance costs of a system for the emission control of a coking operation;

to avoid the direct contact between the showering liquid and the coke cake as it is being pressed out of the coking oven or furnace; and to optimally utilize for the cleaning operation the heat convection current which is generated as the coke cake is being pressed into the quenching car or wagon through the guide carriage.

SUMMARY OF THE INVENTION

The method according to the invention is performed by spraying the liquid drops in a direction extending substantially perpendicularly to the flow of the air gas dust mixture, whereby the volume of the individual liquid drops, the surface tension of these drops, as well as their density and speed are so adjusted or coordinated relative to each other that the liquid drops after they have been loaded with the solid particles will sink downwardly in a countercurrent flow relative to the thermal up flow of the air gas dust mixture to such an extent that they may be led away at a point spaced above the coke cake by baffle inserts which extend throughout the cross-sectional flow area and across the flow direction in a downward slant for the removal of the spraying liquid.

Contrary to the method described in the above mentioned German Patent Publication No. 2,900,079 corresponding to U.S. Pat. No. 4,282,068 the invention does not attempt the suppression of the generation of the air gas dust mixture. Rather, the invention utilizes the thermal upwind or heat convection flow without any additional conveying means for the air gas dust mixture. The heat convection resulting from the pressing out operation of the coke cake into the quenching car provides a sufficient thermal current for generating a substantially vertically upward flow, whereby the hot air gas dust mixture is exposed to a liquid spraying or showering at a point directly upstream of the entrance into the atmosphere. According to the invention the initial spray direction is across the heat convection flow and only afterwards when the drops have accumulated dust particles they sink downwardly in a countercurrent direction in order to bind the solid particles in such a manner that they sink downwardly against the upwardly directed convection flow. The sinking dust laden droplets may then be removed in a direction across the upward flow direction and in a direction slanting downwardly. According to the invention the liquid spraying of the air gas dust mixture is controlled in its force or intensity in such a manner that a high proportion of the solid particles is taken up or bound by the liquid drops without interfering with the thermal upwind of the air which has been cleaned of the solid components. The invention further avoids that any substantial quantity of spraying or showering liquid contacts the glowing coke cake. Thus, an increased dust formation is avoided by contacting the dust particles already formed and while travelling upward with the heat convection current, and by entraining so to speak, these travelling dust particles out of the convection current into the liquid droplets which sink downwardly, it is possible to remove these droplets in a direction slanted downwardly and collect the dust laden liquid drops before they have a chance to contact the glowing coke cake.

A chimney for performing the method according to the invention comprises at least a lower or bottom opening cross-section which extends at least over a portion of the outline or floor plan of a quenching car. Further, the lower portion of the chimney has a side opening which is adapted to the length and height of a coke cake guiding carriage. At least one showerhead is arranged in the upper portion of the chimney and baffle inserts are provided below the showerhead in such a manner that the baffle inserts extend through the chimney cross-sectional area with a downward slant. According to the invention the chimney has a cross-sectional area in its lower portion which diminishes symmetrically relative to the longitudinal central axis for about two thirds of the entire axial length of the chimney, from the lower cross-sectional opening or inlet port toward a central portion to form a nozzle inlet shape. The central portion forms a nozzle neck of smallest cross-sectional area in which the intercepting baffles are inserted. The upper portion then widens again away from the nozzle neck to the upper outlet port as a diffuser structure.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
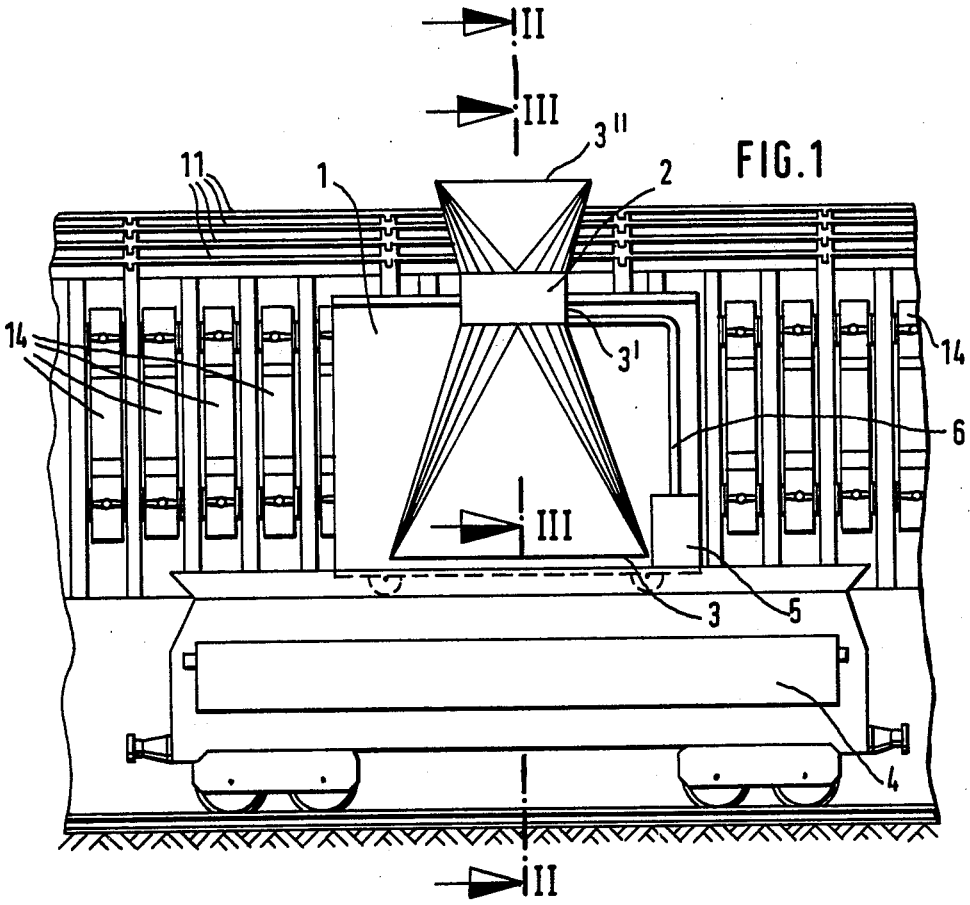
FIG. 1 is a side view of a coking furnace plant portion including a quenching car positioned below the horizontal coking furnace chambers and below a coke cake guiding carriage equipped with a chimney according to the invention.
Figure 2:
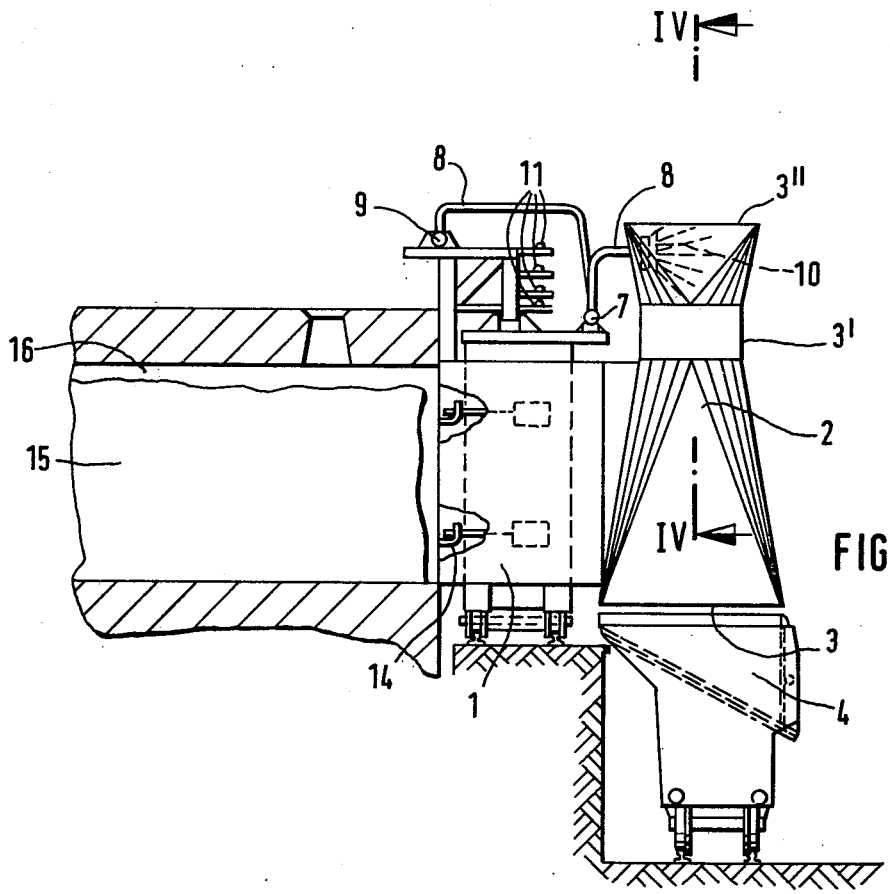
FIG. 2 is a sectional view along section line II—II in FIG. 1.

FIGS. 1 and 2 illustrate and example embodiment in which a chimney 2 according to the invention is secured to a coke cake guide carriage 1. The downwardly facing inlet port or opening cross-sectional area 3 reaches over a portion of the floor plan of a quenching car 4.

As shown in FIG. 1 a sludge water tank 5 is connected to the central nozzle neck 3' of the chimney 2 by means of the duct or pipe 6. The upper portion 3" is formed as a diffuser connected to the nozzle neck 3' which in turn is connected to the inverted funnel of the lower chimney portion which has an axial length corresponding to about two thirds of the entire axial length of the chimney 2.

As shown in FIG. 2, a cooling medium pump 7 is arranged at the top of the guide carriage 1. The pump 7 is connected through a conduit system 8 to the cooling medium reservoir 9 and to the showerhead or heads 10. The cooling medium is water and the showerheads 10 are arranged to spray the water drops substantially horizontally into the upper portion 3" of the chimney 2. The guide carriage 1 is movable back and forth in front of the battery of horizontal coke oven chambers and is energized in a conventional manner, through current rails 11.

Figure 3:
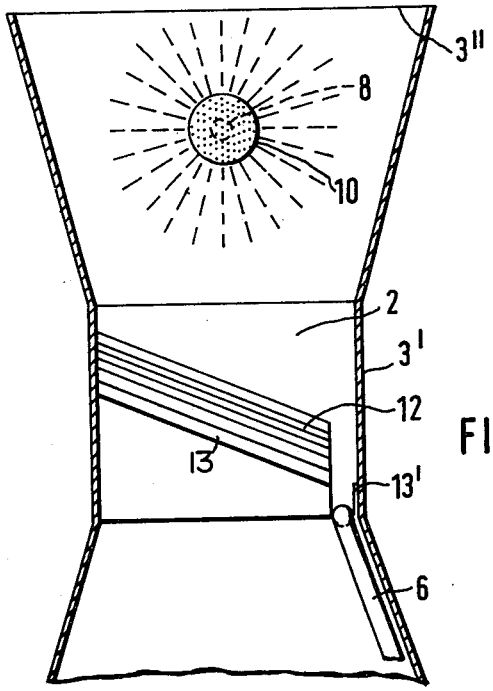
FIG. 3 shows a sectional view through the upper portion of the chimney along section line III—III in FIG. 1.
Figure 4:
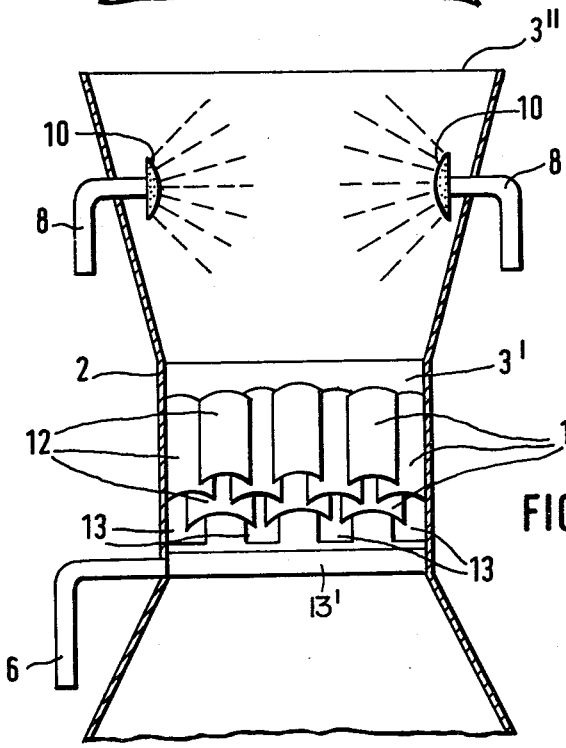
FIG. 4 is also a sectional view through the upper chimney portion along section line IV—IV in FIG. 2.

As shown in FIGS. 3 and 4, the central zone or portion 3' provides a nozzle type cross-sectional contraction. Baffle plates 12, preferably in the shape of concave shelves are arranged at a slant in the nozzle section 3' so that several tiers of such baffle plates 12 extend through the cross-sectional area of the nozzle section 3', whereby the individual baffle plates are staggered relative to each other so that marginal zones thereof are located in a horizontally overlapping relationship, but vertically spaced from each other to thereby provide a complete coverage of the nozzle cross-sectional area. The staggering and vertical spacing provides for vertical slots between adjacent overlapping baffle plates so that the heat convection flow vertically upwardly is still effectively possible. In other words, the baffle plates if arranged as taught herein do not substantially affect the heat convection flow, although in a horizontal direction the entire nozzle cross-sectional area is covered by the baffle plates 12 arranged in several tiers.

Incidentally, the showerhead 10 is so arranged that the liquid spray extends initially substantially across the vertical heat convection flow of the air gas dust mixture. The elevational position of the showerhead and thus of the horizontally extending sprays is such that each drop will have repeated opportunities to contact dust particles in order to bind these particles before the droplets upon becoming heavy enough start sinking downwardly in countercurrent flow direction to the upward direction of the heat convention flow. Due to the above described arrangement of the baffle plates 12, sufficiently below the showerhead 10, the dust laden water drops will be collected by the baffle plates in the central chimney zone 3' when these drops impinge upon the baffle plates 12. The edges of the lowest tier of plates 12 lead into slanted troughs 13 as shown in FIG. 4.

It has been found that the efficiency of the operation of the baffle plates 12 can be substantially increased if each baffle plate has a concave cross-section perpendicularly to its longitudinal axis and if each baffle plate is so located that it faces downwardly with its concave surface directed against the upward heat convection flow of the air gas dust mixture.

The lower ends of the slanted baffle plates 12 lead into a further collection chute or trough 13' which is also slanted downwardly and the lower end of which is connected through the duct 6 to the sludge water tank 5. This arrangement of the collection means makes it possible to fully utilize the natural gravity flow of the liquid bound solid components so that in any event the invention avoids using additional conveying means in the chimney, especially power driven conveying means.

The coke oven battery is provided with liftable furnace doors 14 which are removed from the respective coke oven chamber prior to positioning the coke cake guide carriage 1. When the quenching car 4 has taken up its proper position below the guide carriage 1, that is below the chimney 2 secured to the guide carriage 1, the coke pressing operation is started. An optical, electrical control system monitors the exit of the coke cake 15 from the furnace chamber 16 and switches on the cooling medium pump 7, whereby the latter transports water from the reservoir 9 through the conduits 8 to the showerhead 10. The lower portion of the chimney 2 forming a nozzle inlet captures the air gas dust mixture which is generated when the coke cake 15 collapses and which is thus guided upwardly by its own heat convection flow inside the chimney 2. The lower end or inlet port 3 of the chimney 2 is slightly spaced above the surface of the quenching car 4 to entrain air into the inside of the chimney, thereby generating a sufficiently large flow speed so that no solid components can escape through the gap between the lower edge of the chimney and the top of the quenching car 4.

The upwardly flowing mixture is diverted or detoured repeatedly by the staggered arrangement of the baffle plates 12. By selecting the vertical spacing between the baffle plates and their horizontal displacement relative to each other, it is possible to adjust the flow resistance in accordance with the particular requirements of the individual operating conditions.

Due to the initially horizontal flow of the spray and the then following downward travel of the spray drops, the upward flow of the air gas dust mixture must penetrate through a cooling medium veil which is uniformly distributed throughout the chimney 2, whereby the solid particles are removed from said upward heat convection flow. The water laden with the solid particles then sinks downwardly and is intercepted by the baffle plates 12 which guide the water with the solid particles into the collecting chutes 13 and 13' which in turn feeds into the sludge water tank 5 through the conduit 6. If desired, the content of the tank 5 may be conveyed to another tank on the quenching car 4 prior to the next pressing operation so that the sludge water may be discharged together with any excess quenching water.

It has been found that the air, gas and vapor mixture exiting from the upper end 3'' of the chimney 2 has such a low dust content that it may be discharged into the atmosphere.

Incidentally, it has been found that a quite satisfactory efficiency of the present method will be achieved if the volume or rather, the diameter of the individual liquid drops is within the range of 3 mm–10 mm. This may be accomplished by adjusting the exit openings of the showerhead.

The initial surface tension of the individual liquid drops should be adjusted to be within the range of $70 \cdot 10^{-3}$ N/m. This surface tension adjustment may be accomplished by temperature adjustment and/or by adding of surface active substances. (Tenside)

The initial density of the initial liquid drops should be adjusted to be within the range of 0,95 kg/dm$^3$ to 1,05 kg/dm$^3$. Such density adjustment may be done by adding additives which take influence on the density. The initial horizontal speed of the liquid drops exiting from the showerhead 10 should be adjusted to be within the range of 2–4 m/s. This speed adjustment is accomplished by initial adjustment of the pressure.

Although the invention has been described with reference to specific example embodiments, it will be appreciated, that it is intended to cover all modifications and equivalents within the scope of the appended claims.

What is claimed is:

1. A method for reducing the emission of solid particles from a chimney forming a channel in which an air, gas, and solid particle mixture rises substantially vertically due to a heat convection current of given upward draft resulting from the discharge and collapse of a batch of hot coke from a horizontal coking chamber, comprising the following steps: avoiding any quenching of the hot coke being discharged for permitting the development of said heat convection current without any steam in said mixture, then exposing the substantially vertically rising mixture of hot air, gas and solid particles to a shower of scrubbing liquid drops which are directed substantially horizontally into the rising mixture again without causing any quenching of the coke being discharged, adjusting in combination the initial volume of the individual liquid drops, the initial surface tension of the individual liquid drops, the initial density of the individual liquid drops, and their initial substantially horizontal speed relative to each other so that the scrubbing liquid drops remain suspended in said given upward convection current draft for loading with solid particles until the loaded drops become too heavy for remaining suspended in the upward convection current draft and sink downwardly solely by gravity in countercurrent flow to the upward draft of the convection current, collecting the liquid drops laden with solid particles below said shower without contacting said hot coke for preventing substantially any steam generation to maintain said upward convection current draft undisturbed, and discharging the collected liquid without condensation from the chimney by preventing a direct contact between the loaded drops and the coke as the latter is being pressed out of the coking chamber.

2. The method of claim 1, wherein said liquid drops are drops having a diameter within the range of 3 mm to 10 mm, an initial surface tension within the range of $70 \cdot 10^{+3}$ N/m, an initial density of 0.95 kg/dm$^3$ to 1.05 kg/dm$^3$, and an initial horizontal speed within the range of 2 m/s to 4 m/s.

3. The method of claim 1, wherein said upwardly rising mixture is channeled through a portion of said chimney having a narrowest chimney cross-section and wherein said collecting of the downwardly falling, particle laden drops takes place in said narrowest chimney cross-section.

4. A method for reducing the emission of solid particles travelling in a substantially vertically upward heat convection current of a hot gas, air and solid particles mixture resulting from discharging a batch of coke from a coking chamber, comprising the following steps: avoiding any quenching of the hot coke being discharged for permitting the development of said heat convection current without any steam in said mixture, then channelizing said upward heat convection flow into a funnel type guide channel, causing the channelized flow to travel through a nozzle restriction for causing an accelerated upward draft without any quenching of the coke being discharged, diffusing the flow above the nozzle restriction as the flow exits from said nozzle restriction, spraying scrubbing liquid drops of a diameter between about 3 mm to about 10 mm substantially horizontally into the diffusing flow to keep the drops suspended in the diffusing flow for entrapping solid particles in said suspended liquid drops until gravity alone causes the particle laden liquid drops to sink substantially in countercurrent direction to the upward convection current, intercepting the falling particle laden liquid drops in said nozzle restriction and guiding intercepted particle laden liquid out of said nozzle restriction to substantially prevent particle laden liquid from entering into said funnel type guide channel to avoid contacting the coke being discharged with the particle laden liquid drops for preventing substantially any steam generation to thereby maintain said upward convection current undisturbed and to avoid condensation.

5. An apparatus for reducing the emission of solid particles from an upward heat convection current of a mixture of air, gas and solid particles which current rises substantially vertically in the apparatus as a result of the discharge of a hot coke charge from a horizontal coking chamber without any quenching of the hot coke charge, comprising housing means having a given vertical length along a central axis, a lower portion, a central portion merging into said lower portion, and an upper portion merging into said central portion, said portions defining a chimney channel for said upward heat convection current, said lower portion forming a downwardly facing inlet port of a size sufficient to receive said mixture as it begins to form said heat convection current, said lower portion having inclined side walls extending substantially symmetrically relative to said central axis from said inlet port to said central portion for forming a nozzle inlet shape, said lower portion with its inclined side walls having a vertical height corresponding to about two thirds of said given vertical length, baffle means, said central portion forming a nozzle neck having an axial length sufficient for holding said baffle means operatively located in said nozzle neck for collecting downwardly travelling, particle laden liquid drops before any liquid drops can contact the hot coke charge being discharged for preventing substantially any steam generation to thereby maintain said upward heat convection current undisturbed and to avoid condensation but permitting the upward travel of said heat convection current, said upper portion also having side walls oppositely inclined relative to said central axis for forming a diffuser connected to said nozzle neck at the lower end of the diffuser and for forming an outlet port at the upper end of said diffuser, and showerhead means operatively connected to said upper portion for spraying liquid drops into said upper portion of said diffuser substantially in a horizontal direction for keeping the liquid drops suspended in said upward heat convection current until the liquid drops have collected sufficient solid particles for then travelling downwardly solely by gravity in countercurrent flow to the upward heat convection current for collection by said baffle means, and wherein said baffle means comprise a plurality of individual shelves arranged at an angle relative to said central axis in said nozzle neck, said baffle shelves being arranged in several vertically spaced tiers and so that the baffle plates in one tier are staggered relative to the baffle plates in an adjacent tier, said baffle plates having such width that marginal zones of baffle plates in one tier overlap such marginal zones of baffle plates in an adjacent tier.

6. The apparatus of claim 5, wherein said baffle plates have a curved shape with a concave side facing the rising heat convection current.

7. The apparatus of claim 5 or 6, further comprising liquid discharge means operatively located below said baffle means for receiving liquid drops from said baffle means, and conduit means operatively connected to said discharge means for removing liquid from said apparatus.

8. The apparatus of claim 5 or 6, further comprising a lateral inlet opening in said lower portion for connecting said lower portion to a discharge device of a horizontal coking furnace, said downwardly facing inlet port of said lower end being so-dimensioned as to cover at least a portion of a coke quenching wagon.

* * * * *

UNITED STATES PATENT AND TRADEMARK OFFICE

CERTIFICATE OF CORRECTION

PATENT NO. : 4,439,274

DATED : March 27, 1984

INVENTOR(S) : Walter Goossens et al

It is certified that error appears in the above-identified patent and that said Letters Patent is hereby corrected as shown below:

Claim 2, line 4, "$70 \cdot 10^{+3}$ N/m," should read:

--$70 \cdot 10^{-3}$ N/m,--.

Signed and Sealed this

Tenth Day of July 1984

[SEAL]

Attest:

GERALD J. MOSSINGHOFF

Attesting Officer

Commissioner of Patents and Trademarks